US007073495B1

(12) United States Patent
Markley

(10) Patent No.: US 7,073,495 B1
(45) Date of Patent: Jul. 11, 2006

(54) METHOD AND APPARATUS FOR CLEANING CONCRETE DURING CUTTING

(75) Inventor: Charles E. Markley, Anaheim Hills, CA (US)

(73) Assignee: Soff-Cut International, Inc., Corona, CA (US)

( * ) Notice: Subject to any disclaimer, the term of this patent is extended or adjusted under 35 U.S.C. 154(b) by 0 days.

(21) Appl. No.: 11/216,337

(22) Filed: Aug. 31, 2005

(51) Int. Cl.
*B28D 1/02* (2006.01)

(52) U.S. Cl. ..... 125/13.01; 451/350

(58) Field of Classification Search ..... 125/12, 125/13.01, 14, 20; 451/350, 352, 353; 299/39.1, 299/39.2, 39.3
See application file for complete search history.

(56) References Cited

U.S. PATENT DOCUMENTS

| | | | | |
|---|---|---|---|---|
| 3,929,377 | A * | 12/1975 | Weaver et al. | 299/1.5 |
| 4,195,403 | A | 4/1980 | Gruber | |
| 4,619,081 | A | 10/1986 | Lipanski | |
| 4,676,557 | A * | 6/1987 | Shope et al. | 299/39.3 |
| 4,769,201 | A | 9/1988 | Chiuminatta et al. | |
| 4,817,235 | A | 4/1989 | Doxey et al. | |
| 4,900,094 | A * | 2/1990 | Sergeant | 299/39.6 |
| 5,006,740 | A | 4/1991 | Palm | |
| 5,084,971 | A | 2/1992 | Remington et al. | |
| 5,539,985 | A | 7/1996 | Wershe | |
| 5,579,753 | A | 12/1996 | Chiuminatta et al. | |
| 5,653,218 | A | 8/1997 | Sakamoto et al. | |
| 5,689,884 | A | 11/1997 | Wershe | |
| 5,701,676 | A | 12/1997 | Itoh | |
| D404,042 | S | 1/1999 | Allen | |
| 5,950,612 | A | 9/1999 | Zuzelo et al. | |
| 6,076,443 | A | 6/2000 | Theising et al. | |
| 6,155,246 | A | 12/2000 | Yamami et al. | |
| 6,536,422 | B1 | 3/2003 | Zuzelo et al. | |
| 2002/0017817 | A1 * | 2/2002 | Nakayama | 299/39.3 |
| 2005/0034715 | A1 | 2/2005 | Terpstra | |

* cited by examiner

*Primary Examiner*—Jacob K. Ackun, Jr.
(74) *Attorney, Agent, or Firm*—Stetina Brunda Garred & Brucker

(57) ABSTRACT

A concrete cutting saw has wheels and a rotating cutting blade that cuts a groove in the concrete surface. A support is mounted to the saw to support the concrete surface adjacent the cutting blade to reduce raveling. One or more nozzles are mounted to the saw and in fluid communication with a gas source to provide a gas stream directed toward the support so the gas stream from the nozzle impinges on a leading end of the support. The one or more nozzles are located adjacent to and in front of a leading end of the support, and preferably blow on opposing sides of the plane containing the cutting blade.

25 Claims, 16 Drawing Sheets

METHOD AND APPARATUS FOR CLEANING CONCRETE DURING CUTTING

BACKGROUND

Concrete can be cut while it is in the green state in order to reduce cracking of the concrete which occurs as the concrete cures and shrinks. If the concrete is cut while green, the concrete is weak enough that the rotating cutting blade spalls the concrete. Thus, if the concrete is cut while it is green, the concrete surface adjacent the cutting blade is supported during cutting, typically by using a skid plate that slides over the concrete surface. But because of the sliding action of the skid plate over the concrete surface any debris interposed between the skid plate and the surface can scratch the green concrete surface, as the surface has not yet cured to its traditional, rock-like hardness. If a rolling support is used, the debris can be pressed into the green concrete surface to create a less than desirable surface. There is thus a need for a way to reduce scratching of the concrete surface during cutting, especially during cutting of green concrete.

Moreover, any debris interposed between the skid plate and the concrete can also cause the skid plate to inadequately support the concrete surface adjacent the debris, and that in turn can cause raveling of the concrete, especially along edges of the groove cut in the concrete surface. This raveling includes spalling, ejection of aggregate, chipping of cement and cracking. This raveling is typically localized to areas around the debris, but if the debris is large enough an entire side of the skid plate can lift enough to inadequately support the concrete and cause a larger damaged area. If the debris is dragged along for some distance, the scratch or loss of support can be extended accordingly. There is thus a need for a way to reduce the loss of support caused be interposing debris between the skid plate and the concrete surface during cutting.

Moreover, when green concrete is cut the cutting blade preferably rotates in an up-cut direction, which expels the cut concrete in the direction of the path which the cutting blade is traveling. These cutting debris are typically in the form of a fine powder. If that powder passes underneath the skid plate it can cause an uneven support of the concrete surface and raveling of the concrete groove being cut. There is thus a need for a way to prevent the cutting debris from passing underneath the skid plate.

When green concrete is cut with a skid plate, the skid plate leaves marks on the concrete surface. In some cases these marks are considered aesthetically undesirable. There is a need for reducing these marks, and preferably eliminating them.

BRIEF SUMMARY

A stream of gas is provided to the concrete in front of the skid plate and adjacent the cutting edge of the rotating, concrete cutting saw blade. The stream of gas blows debris away from the path of the skid plate in order to reduce, and preferably prevent, any sizeable debris from getting between the skid plate and the concrete surface being cut. The gas stream is preferably located in front of the skid plate and directed toward the skid plate. Advantageously the gas stream moves with the skid plate relative to the cutting blade and relative to the saw, and is directed to impinge on the front end of the skid plate at an angle. The velocity and flow rate of the gas stream is preferably sufficient to blow substantially all debris from the path of the skid plate. Less preferably the gas stream blows away particles large enough to provide a scratch or indentation visible to the unaided eye, but allows small amounts of concrete dust to pass beneath the skid plate.

The gas stream is preferably a stream of air provided by a blower fastened to the concrete cutting saw. The blower is advantageously powered by the motor driving the rotating cutting blade, and can be mounted on the same axle as the cutting blade but at an opposing end of the axle. Alternatively, an electrically powered blower can be used, with the blower located anywhere on the saw, but preferably located closer to the leading end of the skid plate. The saw has an electrical power source which is used to power the electric blower.

Less preferably, if the saw is powered by an internal combustion engine, the exhaust from the engine can be placed in fluid communication with the concrete surface in front of the skid plate to clear a path for the skid plate. But the gas temperature and soot make this option less desirable. In all the above embodiments, the volume and pressure of the gas flow is selected to be sufficient to clear a suitably clean path for the skid plate. While a continuous stream of gas is preferred, an intermittent gas stream is also suitable in many applications.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
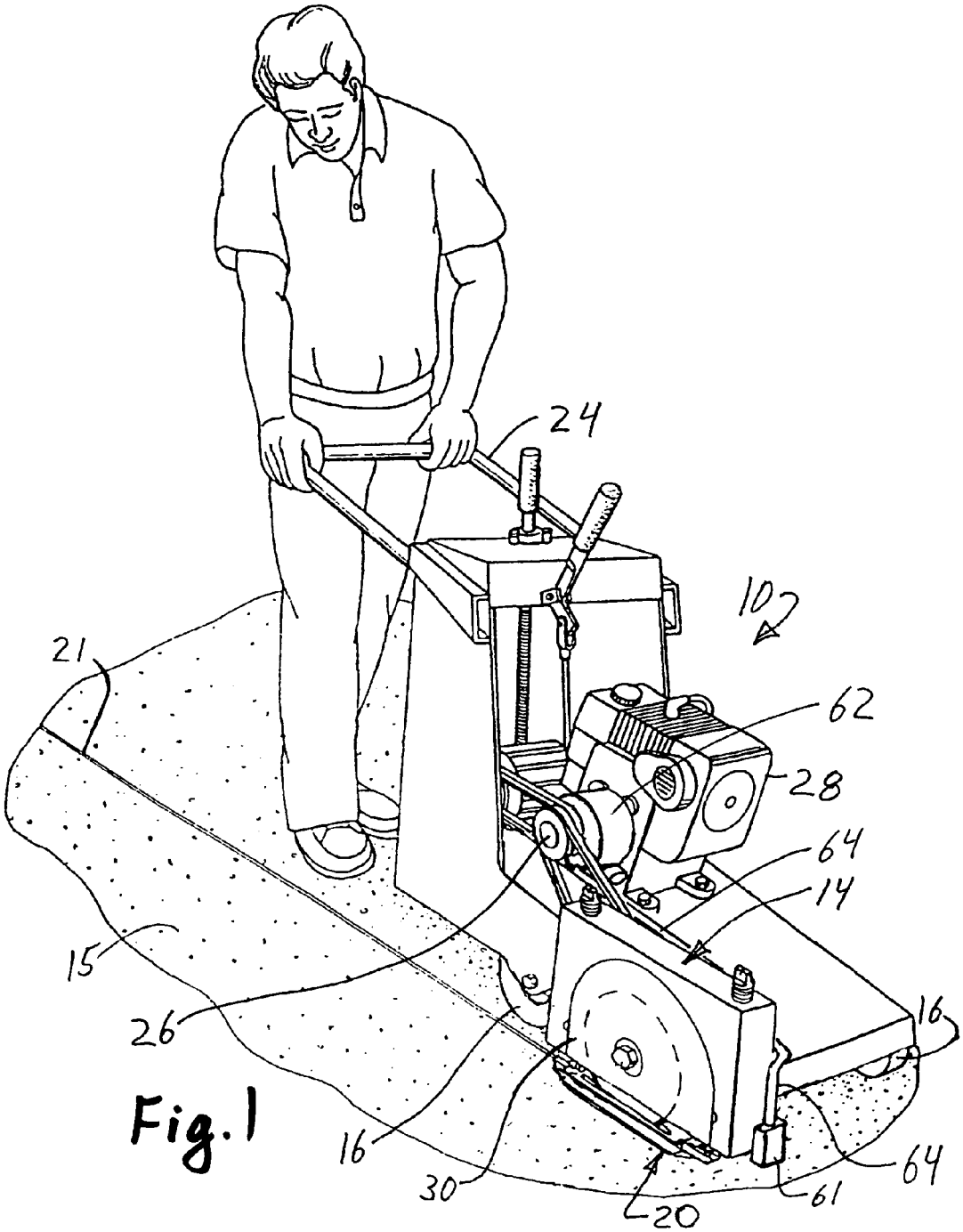
FIG. 1 is a perspective view of a concrete cutting saw configured with a support for the concrete surface during cutting of green concrete, with a gas source and with a gas blower mounted on a blade housing.

Referring to FIG. 1, a concrete saw 10 is shown which has a rotating cutting blade 12 mounted in housing assembly 14 which substantially encloses the blade. The saw 10 is supported on a concrete surface 15 by wheels 16 mounted to axle 18. The concrete surface is supported at the location of the cutting blade 12 by a support 20 which is connected to the saw 10.

The support 20 can comprise a sliding support such as a skid plate, examples of which are described in U.S. Pat. Nos. 5,305,729, 4,769,201, 5,241,946 and in U.S. patent application Ser. No. 10/931,562, the complete contents of which are incorporated herein by reference. The support 20 can comprise a rotating support such as one or more wheels on one or both sides of an up-cutting blade 12, examples of which are described in U.S. Pat. No. 6,536,422, the complete contents of which are incorporated herein by reference. The support 20 can comprise a wheeled tracked support, similar to the tracks used on tanks, an example of which is described in U.S. Pat. No. 5,950,612, the complete contents of which are incorporated herein by reference.

For illustration a skid plate will be used for the support 20. The support 20 reduces raveling of the concrete surface as the blade 12 cuts a groove 21 in the concrete surface 15. While the description is given using a skid plate for illustration, the improvements disclosed herein are applicable to the various other supports 20.

The blade 12 preferably rotates in an up-cut direction. At the leading end of the blade is located a blower 22, which includes at least one, and preferably two gas nozzles 23. More than two nozzles could be used, but space restrictions and clogging issues makes it undesirable to use more than a few nozzles. A nozzle having an orifice of about ⅛ inch is believed suitable, when placed about 2 inches from the front of the support 20. A handle 24, usually at the trailing end of the saw 10, helps steer the saw during use.

As used herein, the front end, leading end, forward direction or leading direction refers to the direction the saw 10 travels during normal cutting. The trailing end, back end, rearward direct or trailing direction is the opposite direction. For the saw 10 shown in FIG. 1 using an upcutting blade 12 the cutting direction is shown by an arrow. As the cutting blades 12 are wear-sensitive to the direction of travel, the forward direction is usually well known.

The saw 10 optionally has a first frame connected to the wheels 16 and supporting the motor 28, and a second pivoted frame connected to a housing assembly 14 around rotating blade 12 in order to allow the blade to be moved into and out of the concrete surface 15. But a single frame could be used with the blade pivoted about the rear axle of the saw to place the blade in contact with the concrete surface 15. Other saw configurations can be used. The saw can be manually pushed, or self propelled by motor 28.

Figure 2:
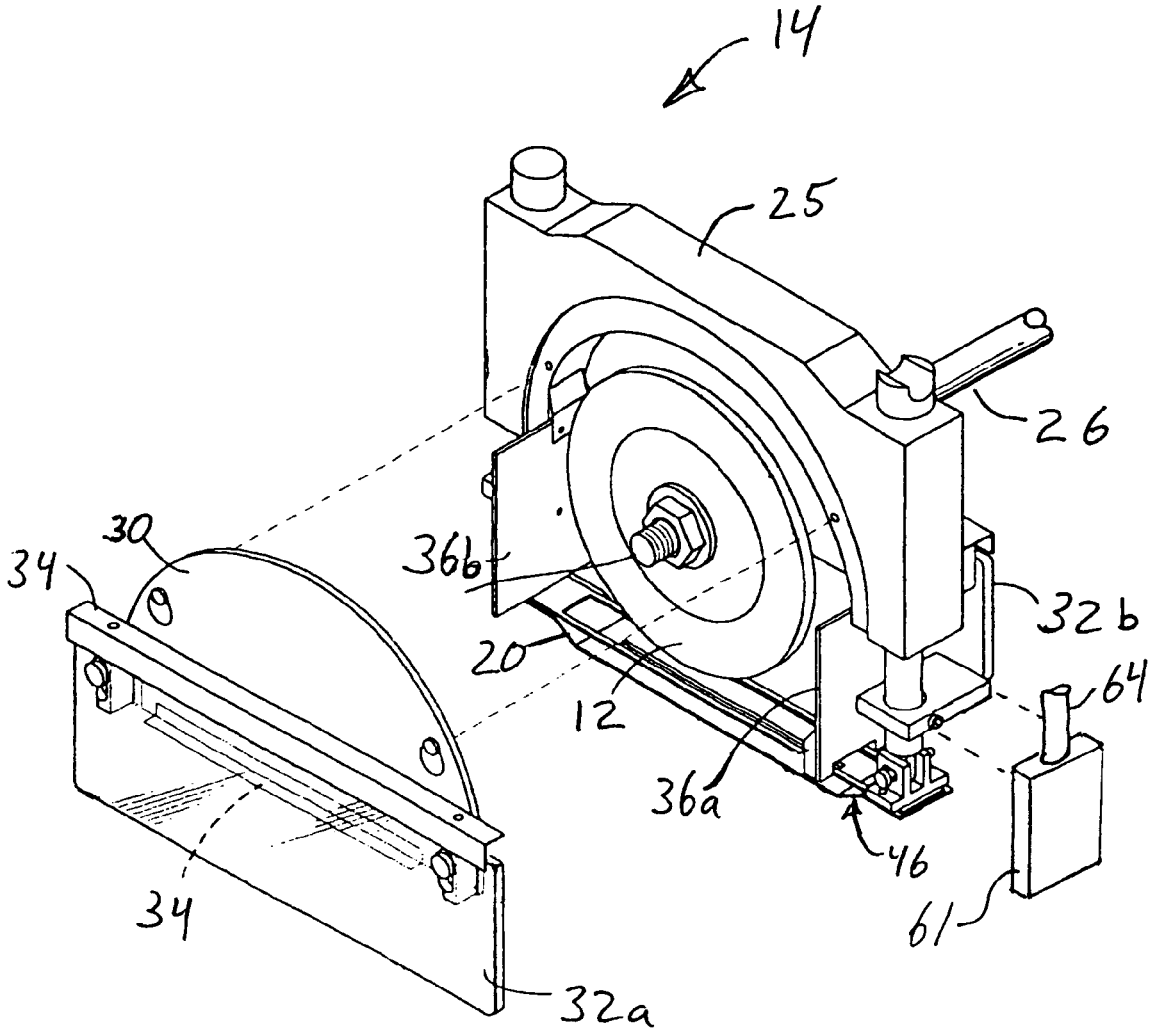
FIG. 2 is a partially exploded, perspective view of an alternative embodiment of a housing enclosing the cutting blade for use with the saw of FIG. 1 and with the gas blower mounted to move with a concrete cutting support.

Referring to FIGS. 1–2, the housing assembly 14 preferably, but optionally, encloses substantially all of the blade 12 which is not in the concrete during cutting. An upper portion 25 is fastened to the saw 10 and encloses at least part of the upper portion of cutting blade 12. A hole or slot in the upper portion 25 housing 14 (not shown) allows a drive shaft 26 driven by motor 28 to rotate cutting blade 12. A removable cover 30 is fastened to the upper portion 25 to allow more complete access to blade 12 when the cover is removed, and to cooperate with upper portion 25 to enclose the upper part of the blade 12. Side plates 32*a*, 32*b* are located parallel to the blade 12 and fastened to the upper portion 25 and cover 30, respectively, in a manner that allows the side plates to move toward and away from the concrete during cutting. Placing slots in the side plates, with pins or fasteners extending through the slots is one of several ways to fasten the side plates 32 while allowing the desired movement. The side plates are long enough to touch or almost touch the concrete surface during cutting, and cooperate with the upper portion 25 and cover 30 to enclose all or most of the sides of the cutting blade 20 which are not in the concrete 15 during cutting. As desired, additional seals 34 can be fastened to cover 30 and upper portion 25 and sized to abut side plates 32 to better seal the parts. In the illustrated embodiment elongated members with L-shaped cross sections are used to help block passage of debris from the cutting blade from escaping. Other shapes for seals 34 can be used, or not used, depending on the configuration of the housing 14.

Leading and trailing shields 36 are fastened to the leading and trailing ends of the upper portion 25. The shields 36 are shown as rectangular plates that fit between the side plates 32*a*, 32*b*, to block debris from exiting the front or rear of the housing 14. The shields 36 extend from the upper portion 25 to the support 20, with shield 36*a* at the leading end and shield 36*b* at the trailing end of the housing 14.

The support 20 is movably mounted relative to the saw 10. The cutting blade 12 and the housing 14 that encloses the blade 12 are mounted to a frame of the saw, and the support 20 is mounted to move along the concrete surface 15 relative to the blade and saw. For the support 20 illustrated as a skid plate, there are two shafts 38*a*, 38*b*, one at each end of the skid plate. The shafts 38 are resiliently connected to the upper portion 25 so allow the skid plate to move toward and away from the concrete surface 15. A removable pin 39 cooperates with a hole in a boss of the support 20 to removably fasten trailing end of the support to the trailing shaft 38*b*. A pin 39 in the shaft 38*a* at the leading end of the support 20 engages a slotted boss fastened to the leading end of the support 20 to fasten the leading end to the leading shaft 38*a*. The shields 36 are preferably, but optionally located between the cutting blade 12 and shafts 38.

The shields 36, side plates 34, cover 30 and upper portion 25 cooperate to substantially enclose the portion of the cutting blade 12 that is not in the concrete during cutting and form housing 14. The side plates 32 preferably ride along the concrete surface and block debris from cutting blade 12 from leaving the side of the housing 14. The side plates 32 are preferably sufficiently light that they do not mark the concrete surface, at least to the unaided eye. The front shields 36*a* and support 20 prevent most debris from cutting blade 12 from leaving the leading end of the housing 14. There is a gap between the support 20 and trailing shield 36*b* adjacent the concrete surface 15 which allows debris to leave the housing 14 at the trailing end. The shield 36*b* preferably, but optionally stops at the support, and the support is smaller than the spacing between the side plates 32, so debris such as concrete dust are pushed off the trailing end of the skid plate 20 and onto the concrete surface 15 where it passes beneath the trailing shield 36*b* and inside the side shields 32. As desired, a scraper or shield 37 (FIGS. 3–4) can be mounted off the support 20 or shaft 38 to guide the debris away from the saw 10, or out of the way of any wheels 16 which might run over the debris. The shield 37 should be mounted so it does not mark the concrete surface 15.

The leading shield 36*a* preferably has the sides of the shield adjacent the side plates 32*a*, 32*b*, extend downward to about the bottom of the support 20 adjacent the concrete surface 15. Tabs extending generally parallel to the cutting blade 12 can be added on these lower corners to further inhibit debris from exiting the leading end of the housing 14. The lower corners of the shield 36*a* are sized so they do not abut the concrete surface 15 so as to leave a mark visible to the unaided eye. The housing 14 preferably, but optionally, leaves the support 20 able to move toward and away from the concrete surface 15 and to move relative to some or all of housing 14.

Other constructions for housing 14 are suitable for enclosing or substantially enclosing the cutting blade 12. Indeed, substantially air-tight enclosures are known which allow low air pressure or vacuum to remove a significant portion of concrete dust from the housing 14, and such enclosures are believed suitable for use with the improvements disclosed herein.

The configuration of the blower 22 can optionally vary with the construction of the support 20. Thus, two variations on the skid plate support 20 are described before describing the details of the blower. The support 20 of FIGS. 2–6 is illustrated with a skid plate having a leading end 46 that is curved such that a bottom surface 44 of the skid plate curves away from the concrete surface 15, with the curved portion oriented perpendicular to the line of travel and perpendicular to the groove 21 being cut by the blade 12. The curved portion straightens out and re-curves to join or form a mounting portion that is parallel to the bottom surface 44. The trailing end of the skid plate 20 is similarly constructed, although the mounting configurations can vary.

Figure 6:
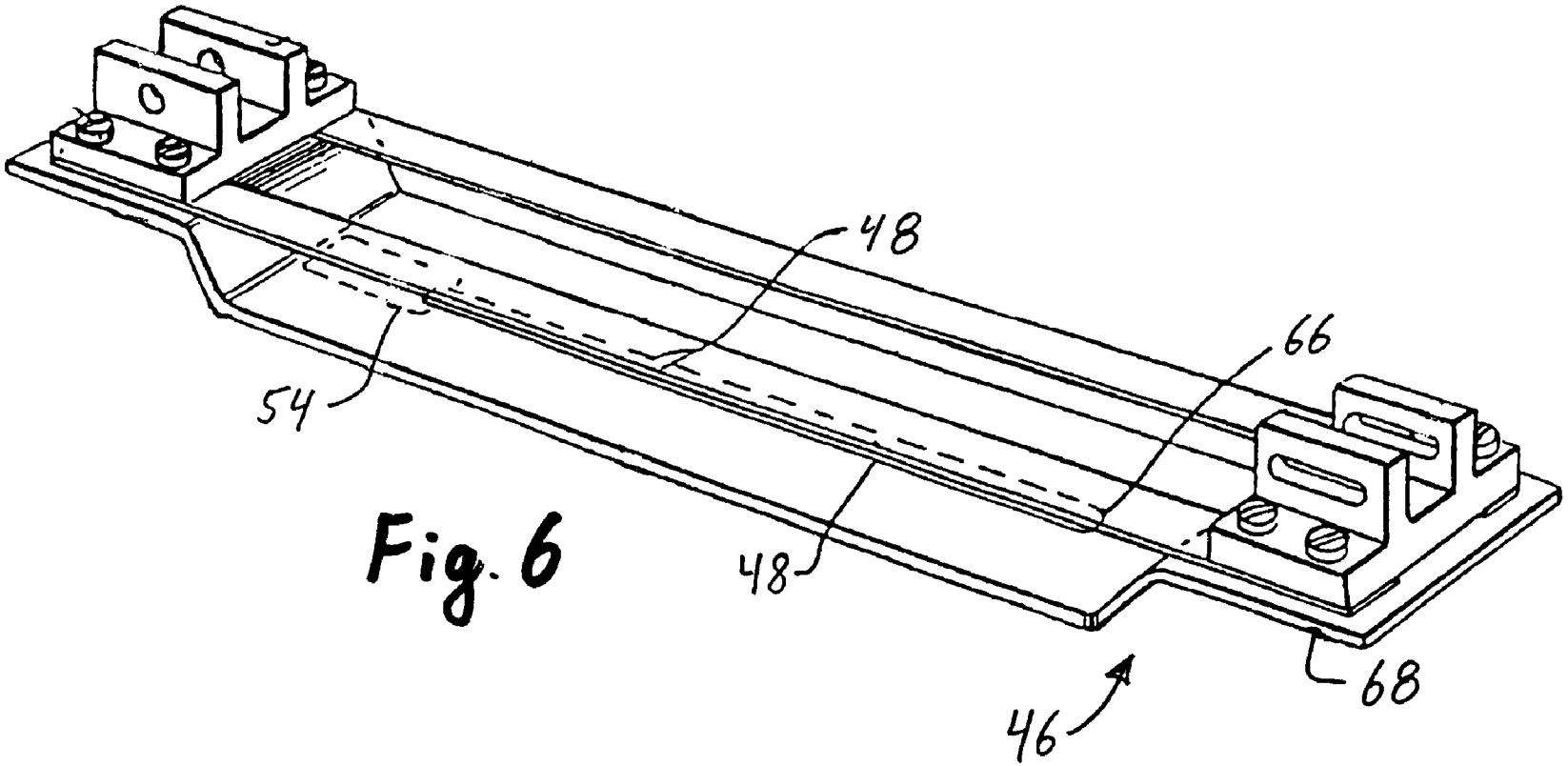
FIG. 6 is a perspective view of the concrete cutting support in which the support comprises the skid plate of FIG. 1.

FIGS. 7–10 illustrate a different configuration with an inclined leading end 46. To reduce marking of the concrete surface 15 the saw 10 preferably uses a support 20 comprising a skid plate that has a leading end that is angled or inclined relative to the groove 15 and to the direction of travel. Such a skid plate is shown in FIG. 6, and is discussed before describing the blower 22 in greater detail.

Figure 7:
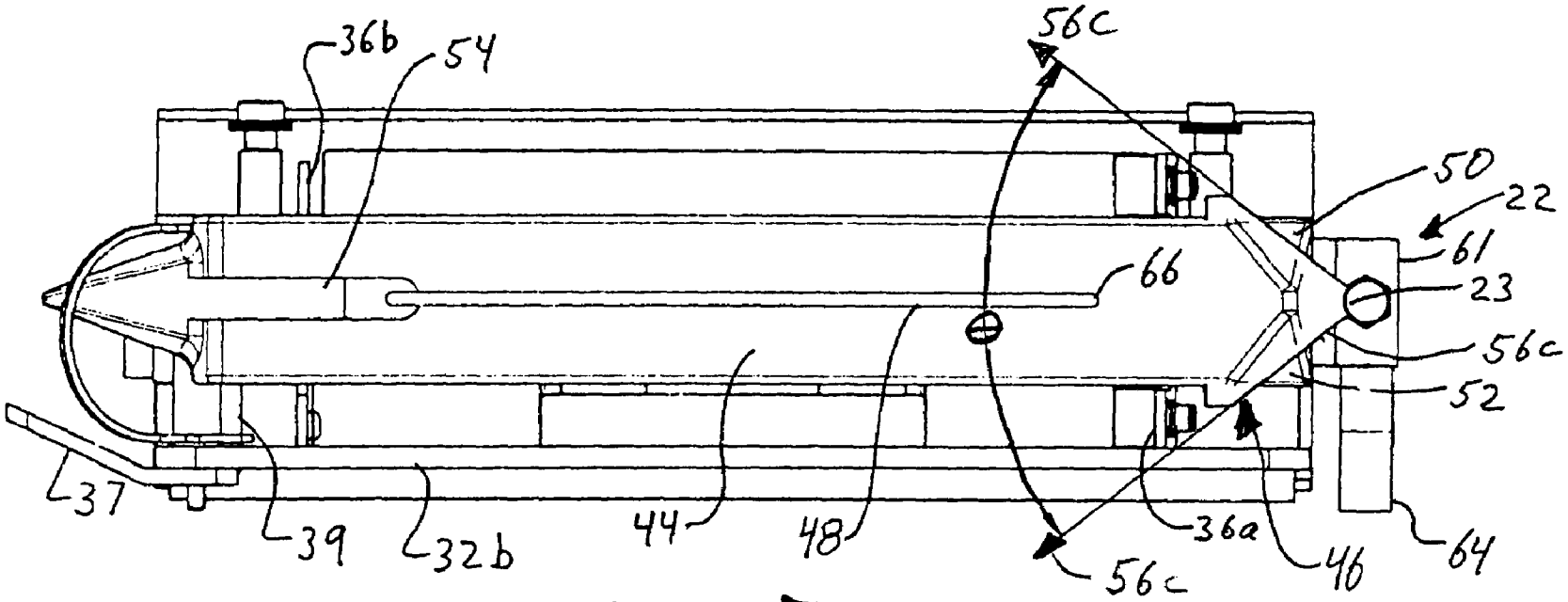
FIG. 7 is a bottom plan view of the housing and concrete cutting support of FIG. 8.
Figure 10:
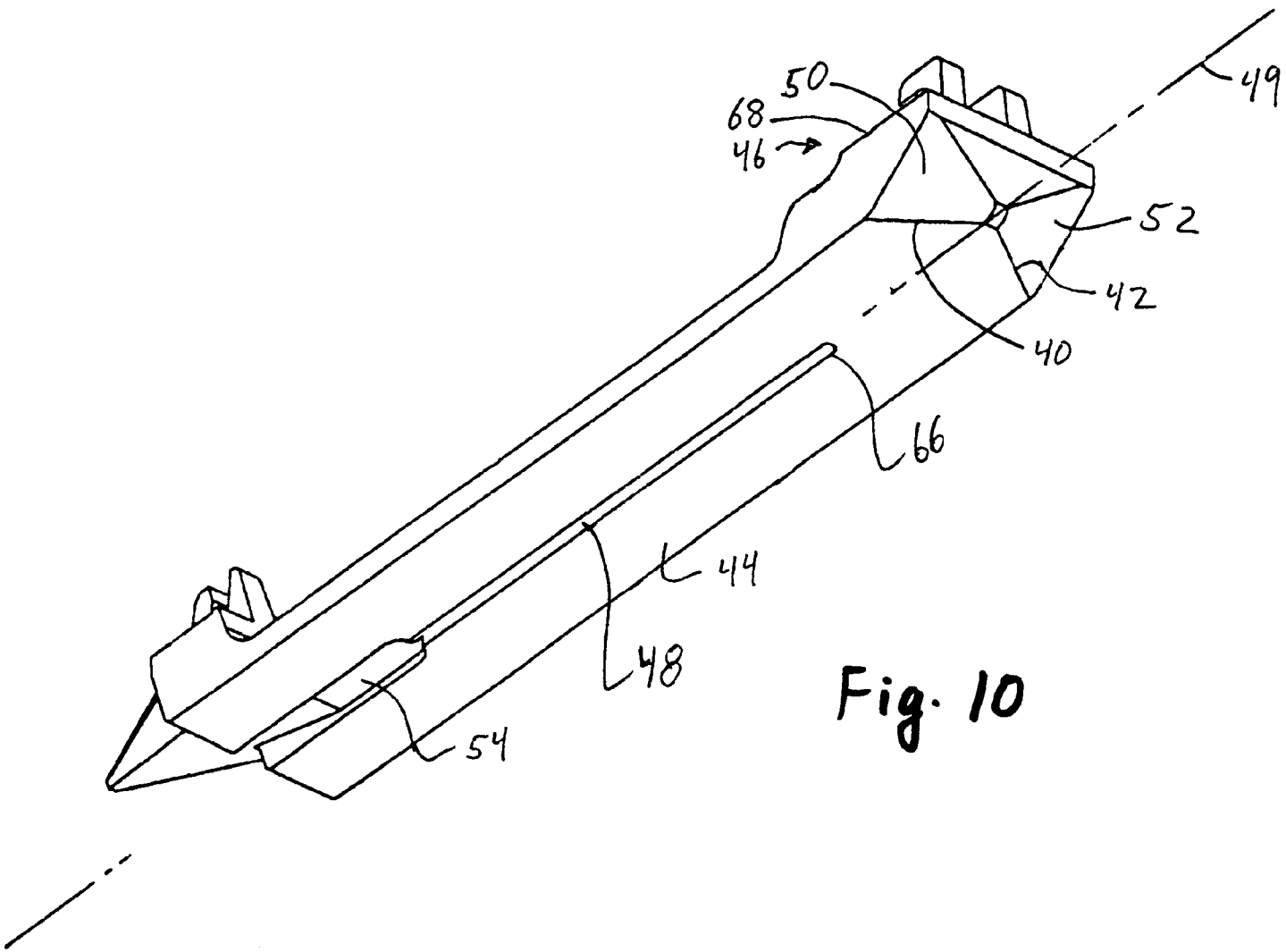
FIG. 10 is a perspective view of the concrete cutting support of FIGS. 7 and 8.
Figure 11:
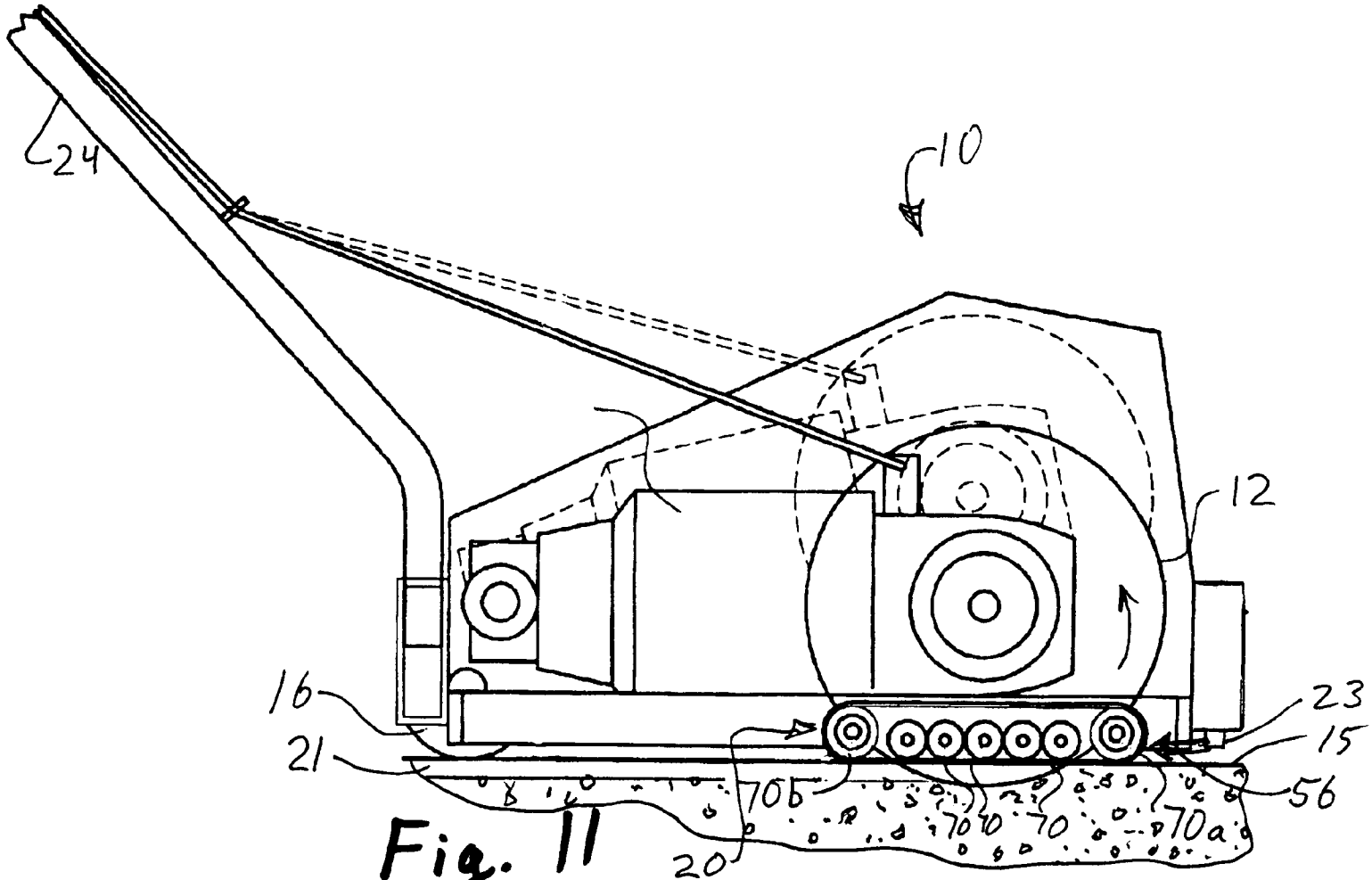
FIG. 11 is a side perspective view of a further embodiment of a skid plate using a plurality of rollers with the blower of FIG. 3.

Referring to FIGS. 7 and 10, the leading end of the skid plate 20 in this embodiment is preferably, but optionally, angled relative to the direction of travel along groove 21 rather than perpendicular to the groove and to the direction of travel. The trailing end is inclined away from the concrete surface 15, but in a plane that is orthogonal to the plane of the cutting blade 12, groove 21 and longitudinal axis 49.

This angled leading end of the skid plate which is in contact with the concrete surface 15 is referred to as angled leading end 40. Preferably, but optionally, two angled ends 40, 42 are used to form a V-shape on the bottom surface 44 of leading end 46 of the skid plate 20, with the apex of the V shaped end located to align with the groove 21 cut in the concrete surface 15. Thus, the intersection of angled ends 40, 42 is preferably in the plane containing cutting blade 20. That location also usually corresponds with the center of the skid plate 20 along which the longitudinal axis 49 of the skid plate 20 extends.

The angled leading end 46 helps the skid plate to avoid running over concrete debris that is removed during cutting or other debris on the concrete surface 15, including sand and grit. Advantageously even the concrete dust is blown away from the path of the support 20 so that the support leaves few or no marks on the concrete surface 15 that are visible to the unaided eye. The blade 12 preferably rotates in an up-cut direction and if the concrete debris removed to form the cut groove 21 get in front of the support 20 then the support can ride over the debris. That can push the concrete debris into the concrete surface 15 and damage the finish on the surface. Further, when the support 20 comprises a skid plate with a slot 48 through which the cutting blade 12 extends, the debris can tilt the skid plate 20 causing the blade 12 to cut and weaken or widen the slot 48 in the skid plate, or it can tilt the saw 10 and rotating blade 12 causing raveling of the cut groove 15. The inclined angle of ends 40 and/or 42 on the front end 46 urges any concrete debris to one side of the skid plate. A single inclined end 40 could be used, with the incline being constant (i.e., straight) or variable (i.e., curved) relative to the longitudinal axis 49 which is co-planar with the slot 48 and groove 21. But a single inclined end could have to move concrete debris across the entire width of the skid plate, whereas two inclined ends 40, 42 forming a V-shaped end centered on the middle of the skid plate and centered on groove 21 and axis 49, need only move debris along half the width of the skid plate 20. Thus, two inclined leading ends 40, 42 are preferred. The angle of inclination will vary, but is advantageously about 100° or more measured from either side of the longitudinal axis 49, and preferably about 110–40.

The front end 46 is also preferably, but optionally inclined relative to the concrete surface 15 so that a portion of the front end 46 extends in front of and over the angled end(s) 40, 42, to form one, and preferably two inclined surfaces 50, 52. The inclined surfaces 50, 52 are inclined from the leading end of the front end 46 toward the bottom surface 44 of the skid plate 10. While it might appear that inclined surfaces 50, 52 would make it easier for the skid plate 10 to ride over concrete debris, it is believed that inclining the surfaces 50, 52 toward the concrete surface 15 and toward the bottom surface 44 will cause the larger concrete debris to roll aside easier or to break up easier and move aside easier.

The inclined leading edges 40, 42 and inclined surfaces 50, 52 are preferably integrally cast with the skid plate 20. As desired, further grinding or machining or cutting of the cast skid plate can more accurately define these ends 40, 42 and inclined surfaces 50, 52. Likewise, the tunnel, groove or slot 54 in the trailing end of the bottom surface 44 is also integrally cast with the skid plate 20, but could be further defined by grinding, cutting or machining if desired.

Referring to FIGS. 1–5, the blower 22 comprises one or more nozzles 23 located at the leading end 46 of the support 20. The nozzles 23 are preferably but optionally mounted off the housing 14, and advantageously fastened to front shaft 38 by mounting bracket 60. The bracket 60 is shown as comprising a clamp bracket that encircles and clamps onto the leading shaft 38*a*, but other mounting brackets and locations could be used. That mounting arrangement allows the nozzles 23 to move with the support 20 relative to the housing 14 and saw 10. That mounting arrangement allows the nozzles 23 to maintain a constant position relative to the leading end 46 of the support 20, and thus ensures a constant level of performance. Because the nozzles 23 are mounted on a part that moves relative to the housing 14 and saw 10, the tubing 64 must be flexible and mounted to accommodate the motion.

The configuration of the nozzles 23 will vary to achieve the desired location of the nozzles. The nozzles 23 are preferably but optionally mounted on a gas distribution manifold 61 which is configured with internal passages to provide a desired amount of pressurized gas to the nozzle or nozzles 23. The configuration of the manifold 61 will vary.

The manifold 61 and nozzles 23 such configured so that the outlet of the nozzles are located adjacent the bottom 44 of the support 20, but do not abut the concrete surface 15 during cutting. The nozzles 23 are in fluid communication with a source of pressurized gas 62 through tube 64. The gas source 62 is preferably an ambient air blower driven by the motor 28 of the saw 10, and is shown as mounted on the motor drive shaft. Various air blower configurations can be used.

Figure 3:
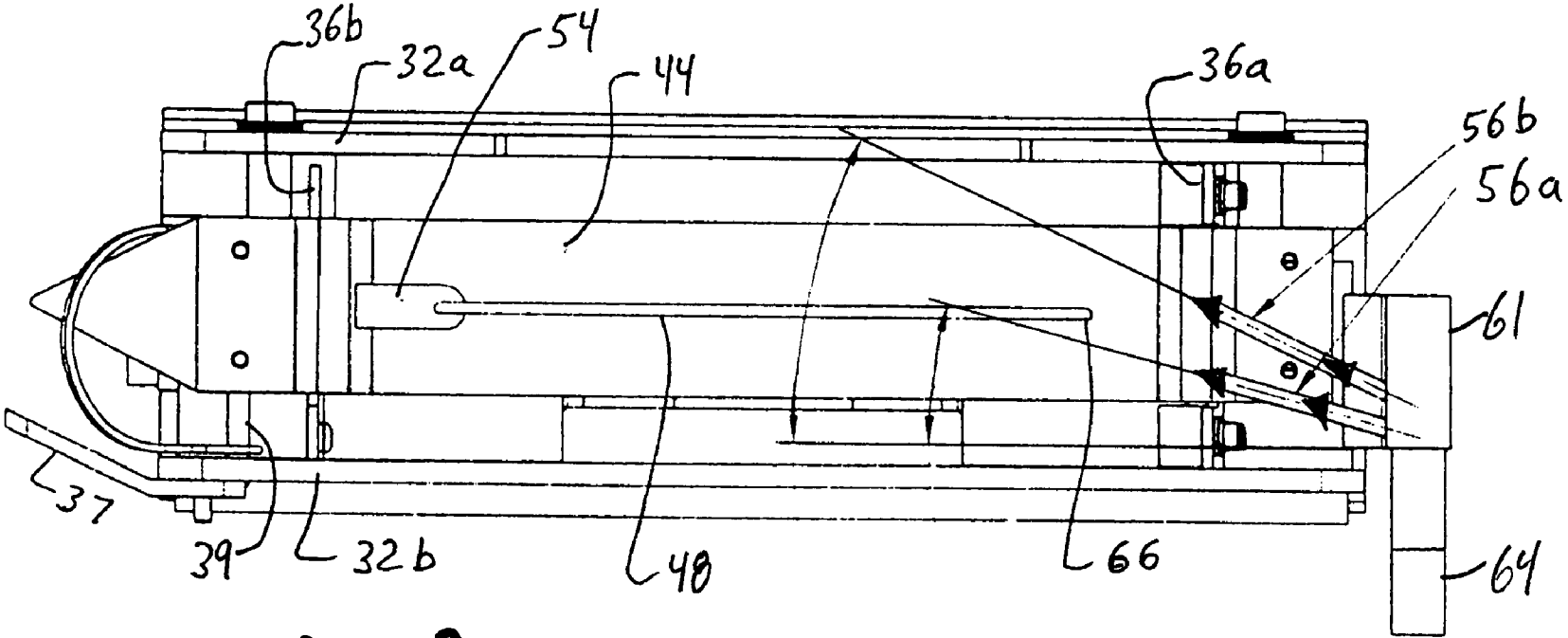
FIG. 3 is a bottom plan view of the housing of FIG. 4 with a gas blower.

As seen best in FIG. 3, relative to the longitudinal axis 49 and axis of the groove 21, the nozzles 23 are located to one side of the support 20 so the stream of pressurized gas is directed across the entire front end 46 of the support 20, traveling across the plane of the cutting blade 12 and groove 21. The nozzles 23 have a generally circular orifice to produce a gas stream having a generally circular cross-section that expands as the distance from the nozzle increases. Other orifice shapes can be used, including oval orifices producing gas streams with generally oval cross-sections, or different shaped orifices producing those generally shaped gas streams. For the nozzles 23 of this embodiment, the gas stream is elongated, and expanded.

The pressurized gas is directed at an angle from the leading end toward the trailing end. Advantageously, but optionally, there are two nozzles 23 spaced apart to produce a first and second gas stream 56*a*, 56*b*, angled at about 15° and 25° respectively to a line parallel to longitudinal axis 49. First gas stream 56*a* hits the leading end 46 of the support 20 between the plane of the cutting blade 12 and the edge of the skid plate 20 adjacent the saw 10. The second gas stream 56*b* hits the leading end 46 of the support 20 on the other side, between the plane of the cutting blade 12 and the edge of the skid plate 20 furtherest from the saw 10. The longitudinal axis 49 and groove 21 are both in the plane of the cutting blade 12, so the above locations are also relative to the plane containing the longitudinal axis 43 and groove 21. The skid plate 20 has a groove 49 through which the cutting blade 12 extends, and a leading end 66 of that groove is close to the cutting blade 12 during cutting. The air streams 56*a*, 56*b* fall on either side of that Preferably, but optionally, the nozzles are oriented to direct the center of the gas streams 56 parallel to the bottom surface 44. Preferably, but optionally, the nozzles produce a gas stream that diverges enough that part of the gas stream is directed to the location where the leading end 46 of the skid plate 20 leaves the concrete surface.

Figure 4:
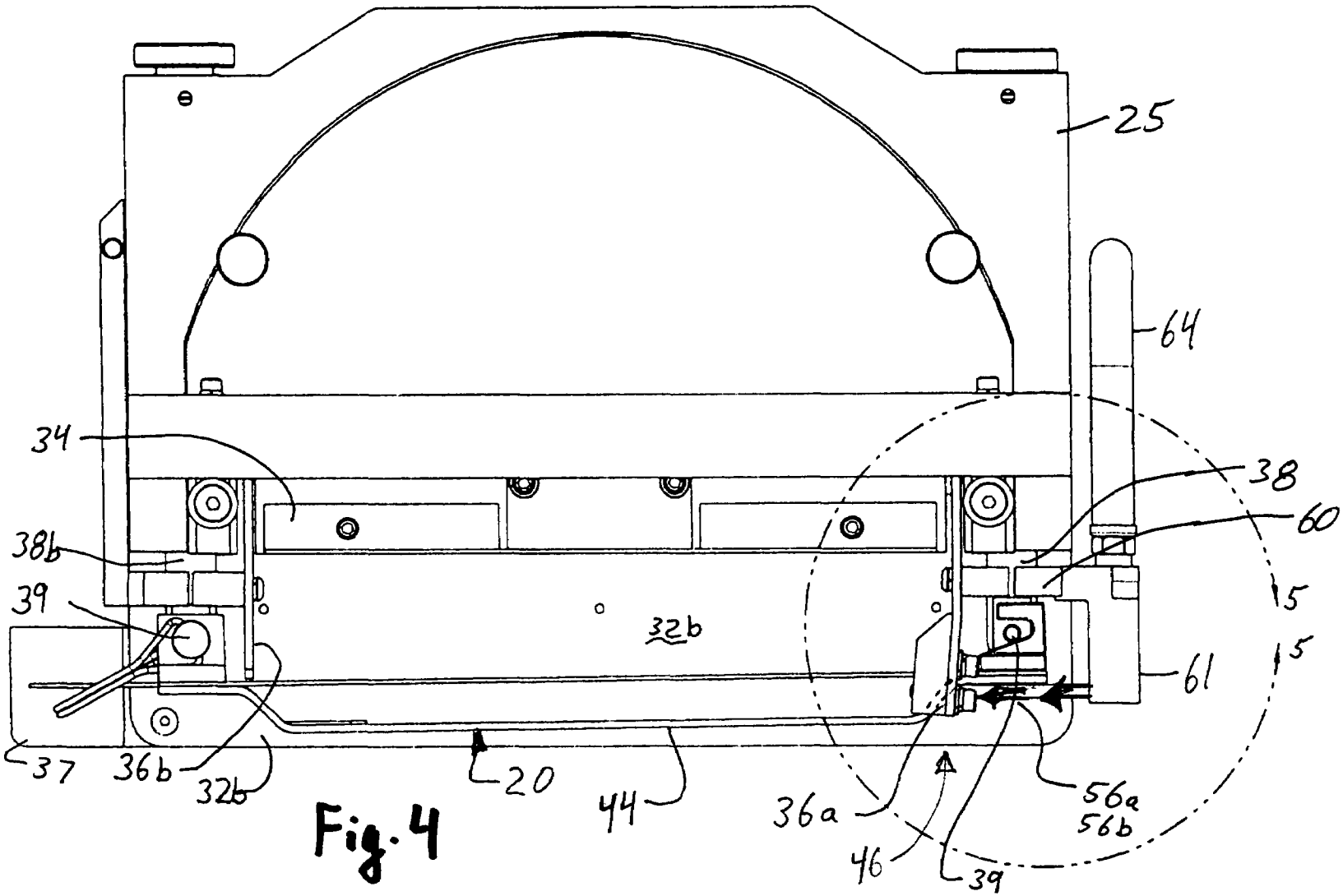
FIG. 4 is a side plan view of the cutting blade housing of FIG. 2 with a side plate removed.
Figure 5:
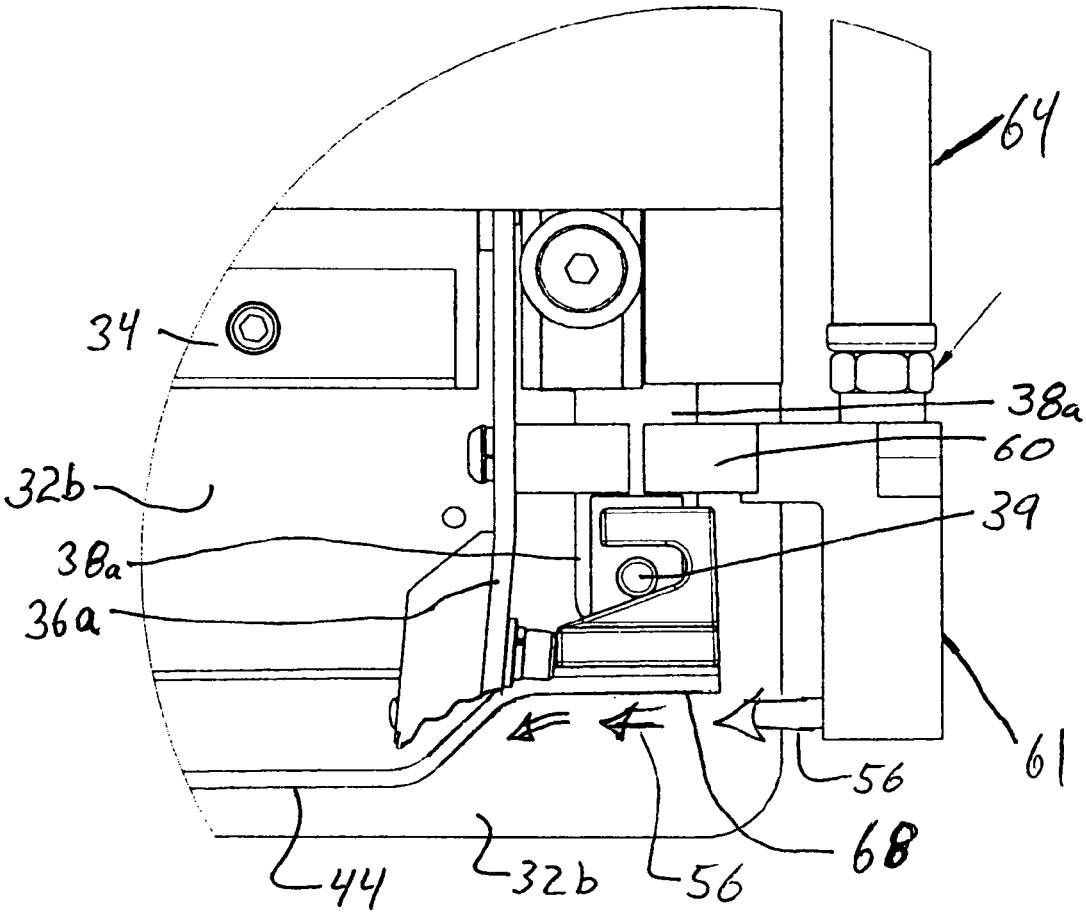
FIG. 5 is an enlarged view taken along section 5—5 of FIG. 3.

As seen best in FIGS. 4–5, relative to the vertical direction, the nozzles 23 are mounted so they are located slightly above the concrete surface 15, advantageously within about an inch (about 2.5 cm), and preferably within about 0.5 inch (about 1.2 cm) of the surface. As seen best in FIG. 5, for the skid plate 20 curving away from the surface 15 and recurving parallel to the surface to form a mounting portion 68, the nozzles 23 blow gas below the mounting portion 68. Preferably the nozzles 23 are mounted so the location at which gas exits the nozzles are located between the two curves forming the leading end 46, or at least direct gas into that area. But the location can vary depending in part on the flow rate and pressure of the gas exiting the nozzles.

Referring to FIGS. 7–10, an alternative embodiment of the blower 22 is provided along with an alternative concrete cutting support 20. The cutting support 20 comprises a sliding skid plate, but one having a different configuration as shown in FIG. 10 and as described above.

Figure 8:
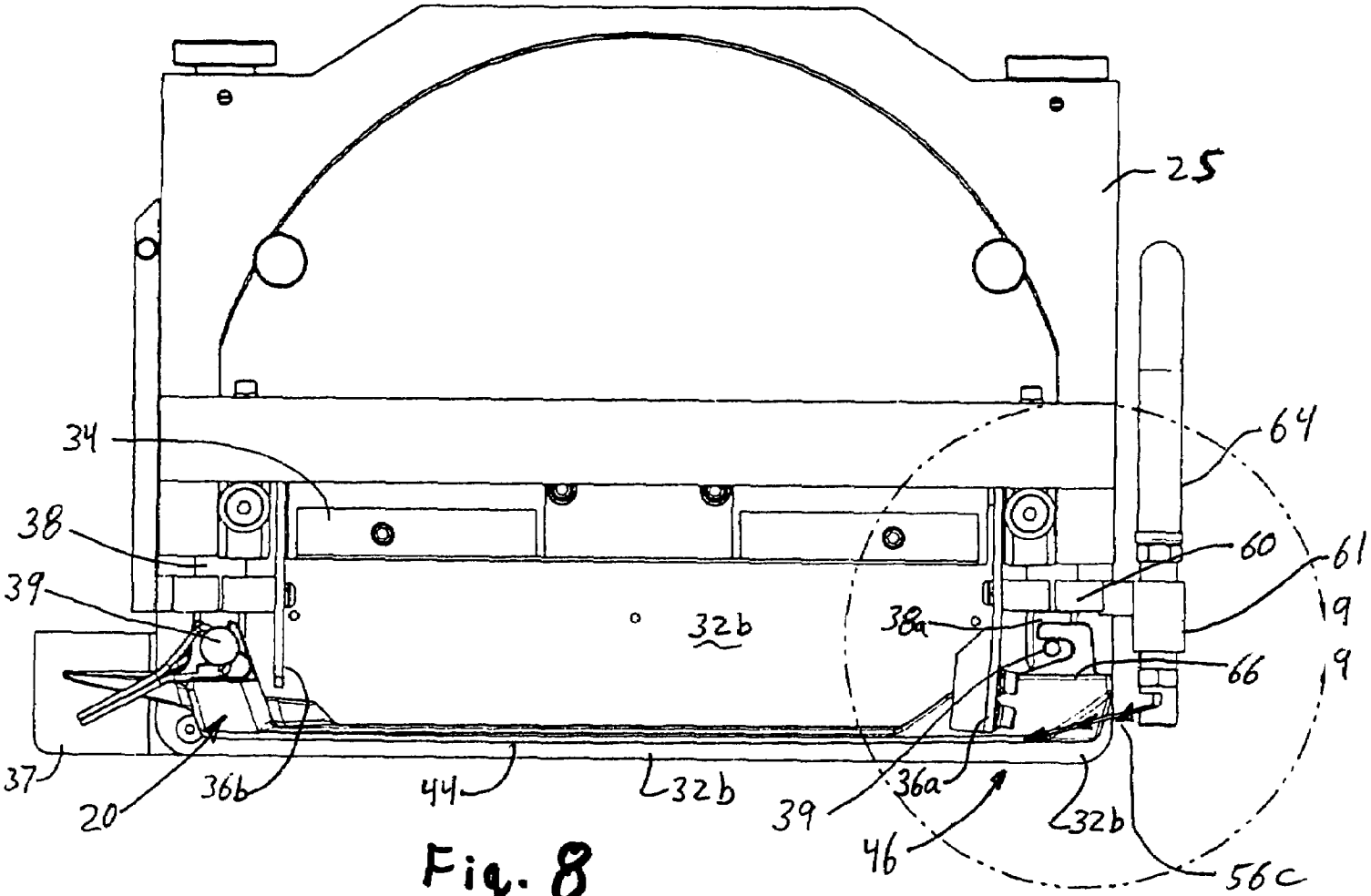
FIG. 8 is a side plan view of the cutting blade housing of FIG. 2 using an alternative embodiment of the concrete cutting support and gas blower.

As best seen in FIG. 8, there is a single nozzle 23 located in front of the leading end 46, below the mounting plane of the skid plate 20 and above the bottom 44 so the nozzle 23 does not hit the concrete surface 15 during cutting. The nozzle 23 is in fluid communication with gas source 62 through tube 64 and gas distribution manifold 61. The manifold is optional. The manifold 61 is preferably but optionally mounted off the housing 14, and advantageously fastened to front shaft 38 by mounting bracket 60. The nozzles 23 are preferably but optionally mounted so that the outlet of the nozzle 23 is located adjacent the bottom 44 of the support 20, but so the nozzle does not abut the concrete surface 15 during cutting. The nozzle 23 is in fluid communication with the source of pressurized gas 62 through tube 64 and manifold 61.

As best seen in FIG. 7, the nozzle 23 is located in the plane of the cutting blade 12, longitudinal axis 49 and groove 21. The nozzle 23 is a fan spray nozzle with an elongated orifice emitting a single, generally planar gas stream 56*c* over an arc θ of about 75°. The arc resembles a fan. The arc 0 can vary considerably, but preferably about half of the gas stream passes on each side of the cutting blade 12. The arc 0 is preferably wide enough to encompass the entire width of the leading end 46 of the skid plate 20 by the time the gas stream 56*c* hits the leading end at the concrete surface 15. For the single nozzle 23 of this embodiment, the gas stream is planar, and expands as the distance from the nozzle increases. For the illustrated embodiment, and arc 0 of about 60–85° is believed suitable.

Figure 9:
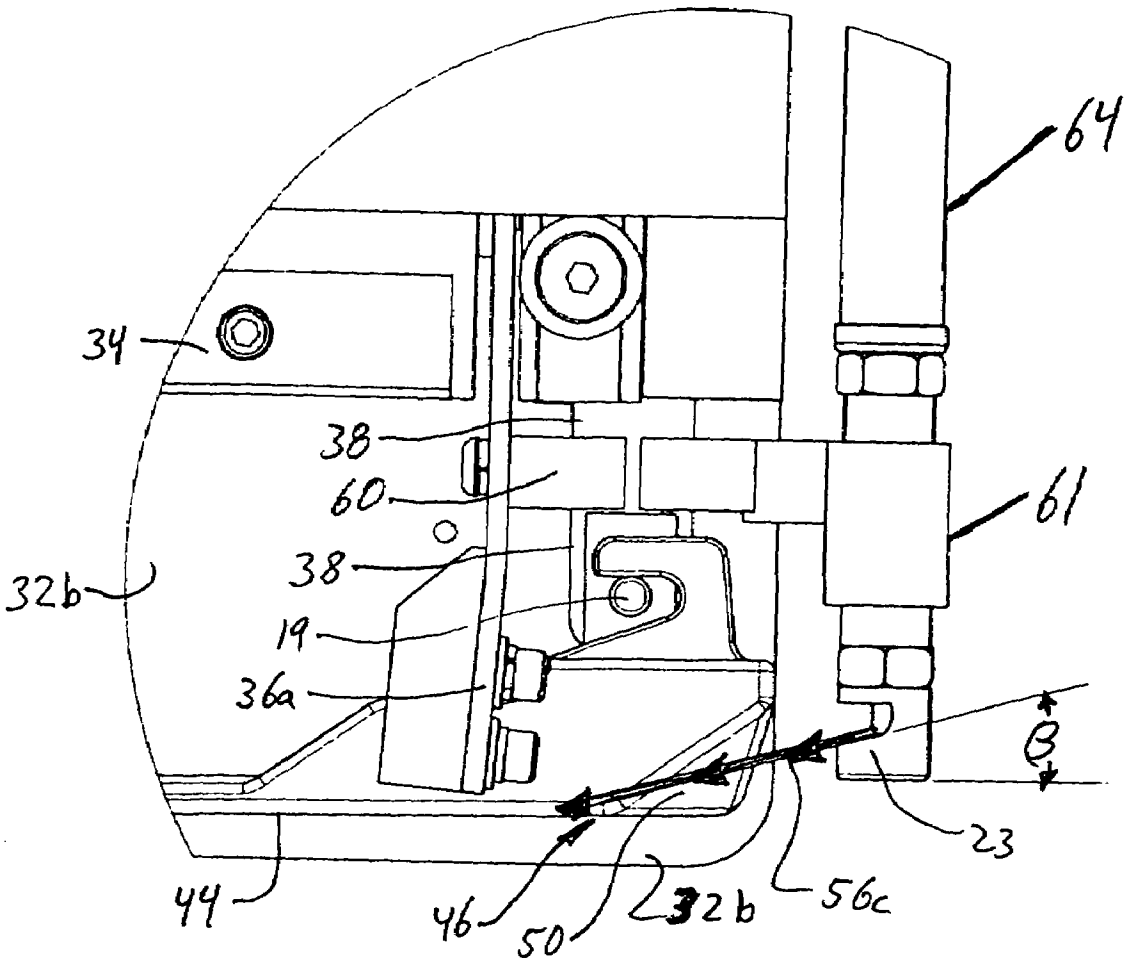
FIG. 9 is an enlarged view taken along section 9—9 of FIG. 8.

The pressurized gas is directed at an angle from the leading end 46 toward the trailing end. As best seen in FIGS. 8–9, the gas stream 56*c* is inclined downward toward the concrete surface 15, above the general location where the leading edges 40, 42 abut the concrete surface 15, and thus along a centerline that would abut the concrete surface 15 slightly toward the trailing end of the location where the leading edges 40, 42 abut the concrete surface. Thus, preferably, but optionally, the nozzle 23 produces a gas stream that is directed to the location where the leading end 46 of the skid plate 20 leaves the concrete surface. A downward angle β (FIG. 9) of about 15° is believed suitable, but the angle will vary with the location of the nozzle 23 and the flow rate and pressure of the gas stream 56*c*. For the illustrated embodiments, angles β of 7–20° are believed suitable.

As seen best in FIGS. 8–9, relative to the vertical direction, the nozzle 23 is mounted so it is located slightly above the concrete surface 15, advantageously within about an inch (about 2.5 cm), and preferably within about 0.5 inch (about 1.2 cm) of the surface. As seen best in FIG. 9, the nozzle 23 blows gas onto the inclined surfaces 50, 52, below the mounting portion 68. Preferably the nozzles 23 are mounted so the location at which gas exits the nozzles are located between the two curves forming the leading end 46, or at least direct gas into that area. But the location can vary depending in part on the flow rate and pressure of the gas exiting the nozzles.

The gas streams 56 blow toward the skid plate 20, but at an angle to direct debris away from the skid plate 20. This is contrary to the prior art which oriented the gas streams so they always had a flow component in the leading or forward direction.

It is also believed that directing the gas streams 56 against the leading end 46 of the skid plate 20 creates an advantageous gas flow or a high pressure area that further urges debris away from the leading end 46 of the skid plate.

The effect of this advantageous gas flow or high pressure area is believed to be further enhanced by directing the gas flow 56 against a front end 46 having a surface inclined about two axes in that the surface is inclined downward toward the concrete surface and inclined rearward toward the trailing end of the skid plate. This dual inclination applies to both the embodiments of the skid plate 20 shown in FIGS. 1–10.

The effect of this advantageous gas flow or high pressure area is believed to be even further enhanced by directing the gas flow 56 against a front end 46 having a surface inclined about three axes in that a surface 50, 52 is inclined downward toward the concrete surface, and inclined rearward toward the trailing end of the skid plate, and also inclined sideways relative to the plane of the cutting blade 12 and is thus not orthogonal to that plane. The sideways inclination can be relative to only one side, or relative to more than one side such as a "V" shaped orientation as in surfaces 50, 52 relative to the plane of the cutting blade 12. This inclination to three axes applies to the second embodiment of the skid plate 20 shown in FIGS. 7–10, but not to the first embodiment of FIGS. 1–6, as the curved surfaces at the leading end 46 are orthogonal to the plane of the blade 12. The multiply inclined surfaces 50, 52 direct the gas stream 56*c* away from the plane of the cutting blade so as to remove debris from the path of the cutting support 12.

The nozzle(s) 23*a*, 23*b* direct a gas stream in a trailing direction other than in the plane of the cutting blade 12 so that the gas streams from the nozzles impinge on a leading end 46 of the support 20. The fan shaped gas stream 23*c* has a small portion (under about 10%) of the gas stream directed in the plane of the cutting blade 12, and the inclined surfaces 50, 52 inclined downward, sideways and rearward channel or direct the small portion of the gas stream in the plane of the blade 12 so as to move debris from the path of the cutting support 12.

It is believed usable, but not preferable, to direct the center of gas stream(s) 56 against the front end of the support 20 rather than at the concrete surface 15 or at the juncture of the bottom 44 and the concrete surface 15. Thus, preferably the center of the gas stream 56 is directed to abut the leading end of the support 20, which end is preferably, but optionally, inclined about two, and preferably three, axes.

Further, the nozzles 23 and resulting gas streams 56 are close to the leading end 46 of the support 20, but are mounted to the saw 10, preferably to the housing 14, so that the nozzles 23 cannot hit and mark the concrete surface 15 during cutting. The nozzles 23 are advantageously mounted in a fixed position, or at least a sufficiently fixed position so the nozzle cannot move a distance sufficient to hit the concrete surface during cutting.

The depicted embodiments use a gas source 62 that uses an air blower driven by the saw's motor 28 either directly as shown, or through a gear train or pulleys. A rotary vane blower or centrifugal blower are believed suitable. Because of the concrete dust from cutting, a good filter is needed on the blower. The gas source 62 could comprise an air compressor with the higher pressure gas placed in fluid communication with the nozzle(s) 23. A single piston compressor or a diaphragm compressor are believed suitable. A flow of 2–3 cubic feet per minute at less than 2 psi, directed toward the front end 46 as described in FIGS. 1–10, from a distance of about 2 inches, is believed suitable. This flow rate is sufficient that, in cooperation with the shape of the front end 46 of the support, nozzles 56*a*, 56*b* remove grains of sand and other normal debris from the path of the support by the gas flow 56.

An air compressor with a gas reservoir to accumulate pressurized gas is believed usable. But because the pressurized reservoir is heavy this option is not as desirable.

Similarly, a separate source of compressed air or gas could be used, such as a rechargeable air tank. But that is not preferred, in part because of weight and air capacity concerns. While not preferred, these sources of higher pressure gas comprise means for providing a source of pressurized gas for the nozzle(s) 23.

The gas source 62 could comprise an air blower or air compressor that is electrically driven, with the electrical power provided by a generator or alternator mounted on the saw 10 driven by the motor 28, or from a separate power source. An electrically power compressor or blower has the further advantage of being more easily located on the saw 10, and preferably located very near the nozzles 23 in order to minimize drag losses through tubing 64. It is believed possible to position an electrical compressor or blower very near the nozzles 23. In some embodiments the saw 10 uses an electrical motor 28 rather than an internal combustion engine, and in those cases the gas source 62 could be powered by the same electrical source.

The gas source 62 could comprise the exhaust from the motor 28 if the motor is an internal combustion engine. But exhaust gas contains combustion products at elevated temperatures and is thus usable, but not preferred. If motor 28 comprises an electrical motor, the air circulated by the rotating armature could be collected and channeled to the nozzles 23 by the tubing 64.

A separate gas source could be provided and placed in fluid communication with the saw 10, but that would require extensive portable gas lines and is thus not preferred. Thus, the gas source 62 preferably comprises a portable source of pressurized gas mounted on the saw 10, and does not include a remotely located source placed in fluid communication with the saw 10. The above described sources of pressurized gas comprise means for providing a source of pressurized gas for the nozzle(s) 23.

The nozzles 23 are shown as being mounted on the housing 14 adjacent the frame of the saw 10, and oriented to blow debris generally away from the saw 10 and support 20 in a rearward or trailing direction. The nozzles could be located on the more distant portion of the housing 14 and oriented to blow the gas streams 56 and debris toward the saw 10. The nozzles 23, manifold 61 and tubing 64 are shown mounted to a part (shaft 38) that moves with the support 20. The nozzles 23 could be mounted elsewhere. The nozzles could be mounted on the movable side plates 32. It is also believed possible to mount the nozzles 23 on the support 20 itself, as for example, by fastening a bracket to the leading end 46 or to other portions of the support 20.

Alternatively, the nozzles 23 could be mounted to a portion of the saw that does not move with the support 20. Thus, for example, the nozzles 23 could be mounted to the upper portion 25 of the housing 14, as shown in FIGS. 13–16. Alternatively, the nozzles 23 could be mounted to the frame of the saw or to other portions of the saw adjacent the leading end of the support 20, either on the exterior side, or underneath. Moreover, the orientation of the nozzle 23 can be variable, as for example, by providing a pivoted mount on the nozzle 23, or allowing for rotation of the nozzle 23. If an alternative mounting location places the nozzles 23 further from the leading end 46 of the support 20, then the nozzle design must be adjusted so the gas flow rate and pressure are sufficient to remove a desired amount of debris.

Referring to FIGS. 13–16, a manifold 61 is mounted to the housing 14, either on the side of the housing facing the motor 28, or facing away from the motor 28. The manifold 61 is in fluid communication with the gas source 62, preferably by tubing that is not shown. The actual connection will vary with the particular construction of the saw 10. A tube 64 connects the manifold 61 to the nozzle 23 that is mounted to one of the side plates 32*a*, 32*b*. Because the side plates 32 can move along an axis generally perpendicular to the concrete during use, the tubing 64 between the manifold 61 and nozzle 23 is sufficiently flexible to allow such movement. If needed, a bend in the tubing or a loop of tubing can be provided to increase this flexibility and accommodate the desired range of movement. The nozzle 23 is located as previously described relative to the front of the skid plate and is orientated as previously described. By fastening the manifold 61 or the nozzle(s) 23 on the side plates 32 or elsewhere, the other arrangements mentioned above can also be achieved.

In the prior art, the green concrete surface 15 was often cut when it was hard enough to walk on behind saw 10, sometimes when the concrete had a hardness of about 500 psi or less. The prior art concrete saws left slight, but visible scrape marks on the concrete surface. Preliminary testing indicates that the preferred gas stream removes enough debris from the path of a sliding support 20 that a sliding support as shown in FIGS. 1–5 leaves little or no visually perceptible marks on the concrete surface 15 when cut walking behind the saw 10.

Figure 12:
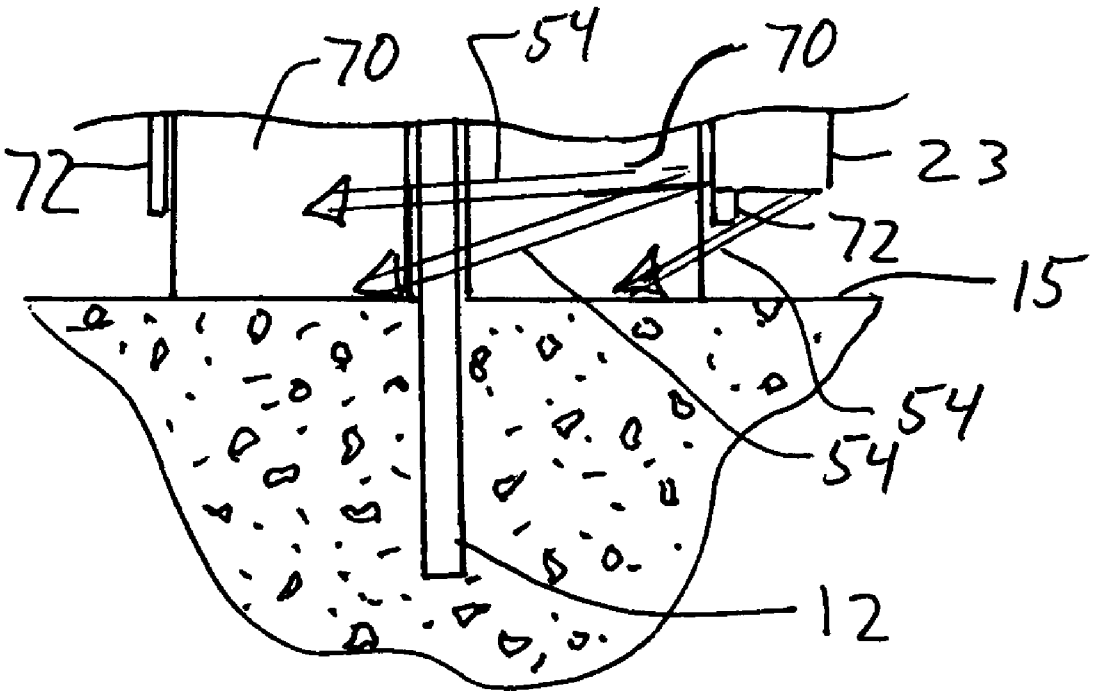
FIG. 12 is a partial sectional view showing a cutting blade, gas stream direction and rollers of FIG. 11.
Figure 17:
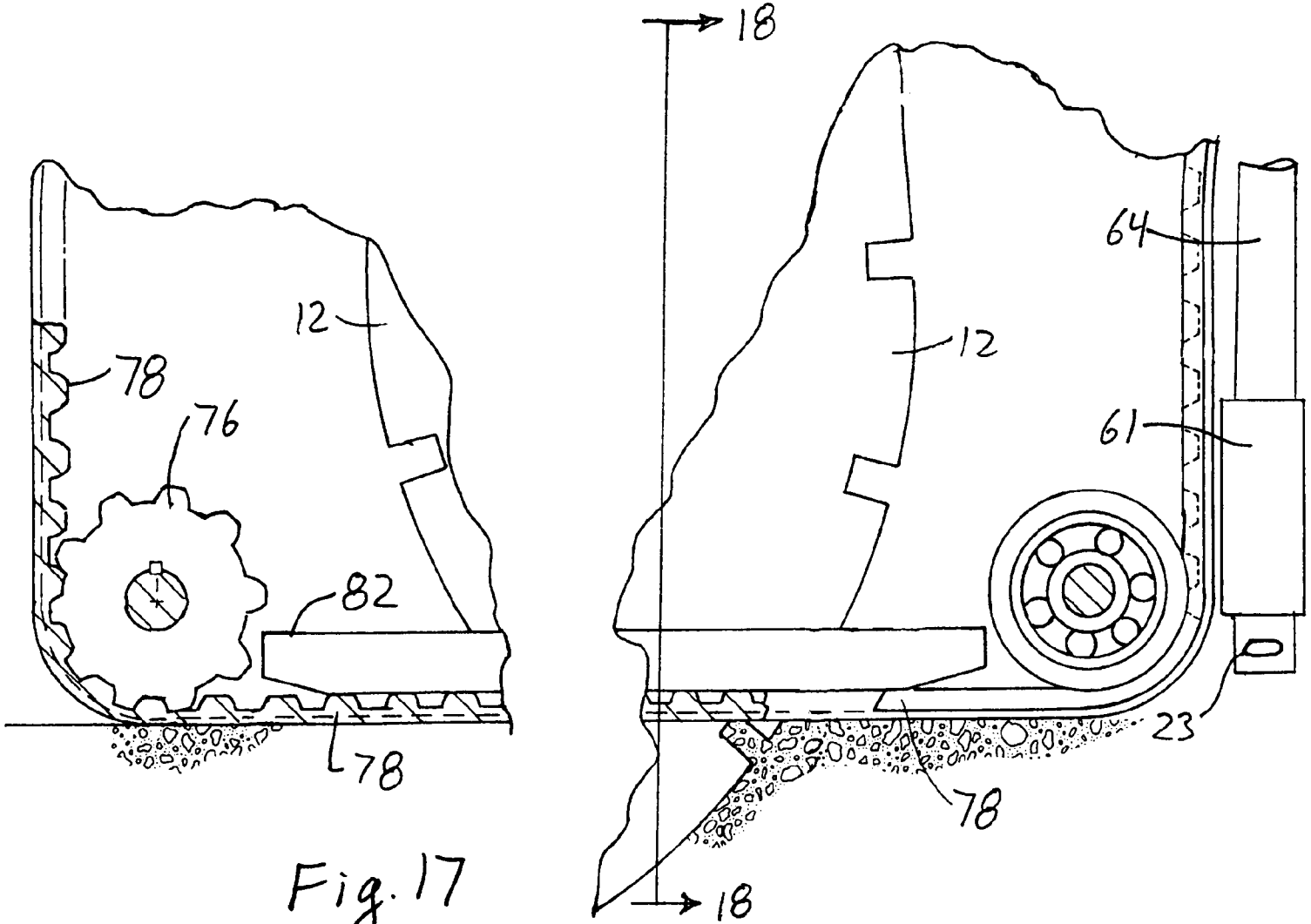
FIG. 17 is a side sectional view of a further embodiment showing a blower on a tracked-support.
Figure 18:
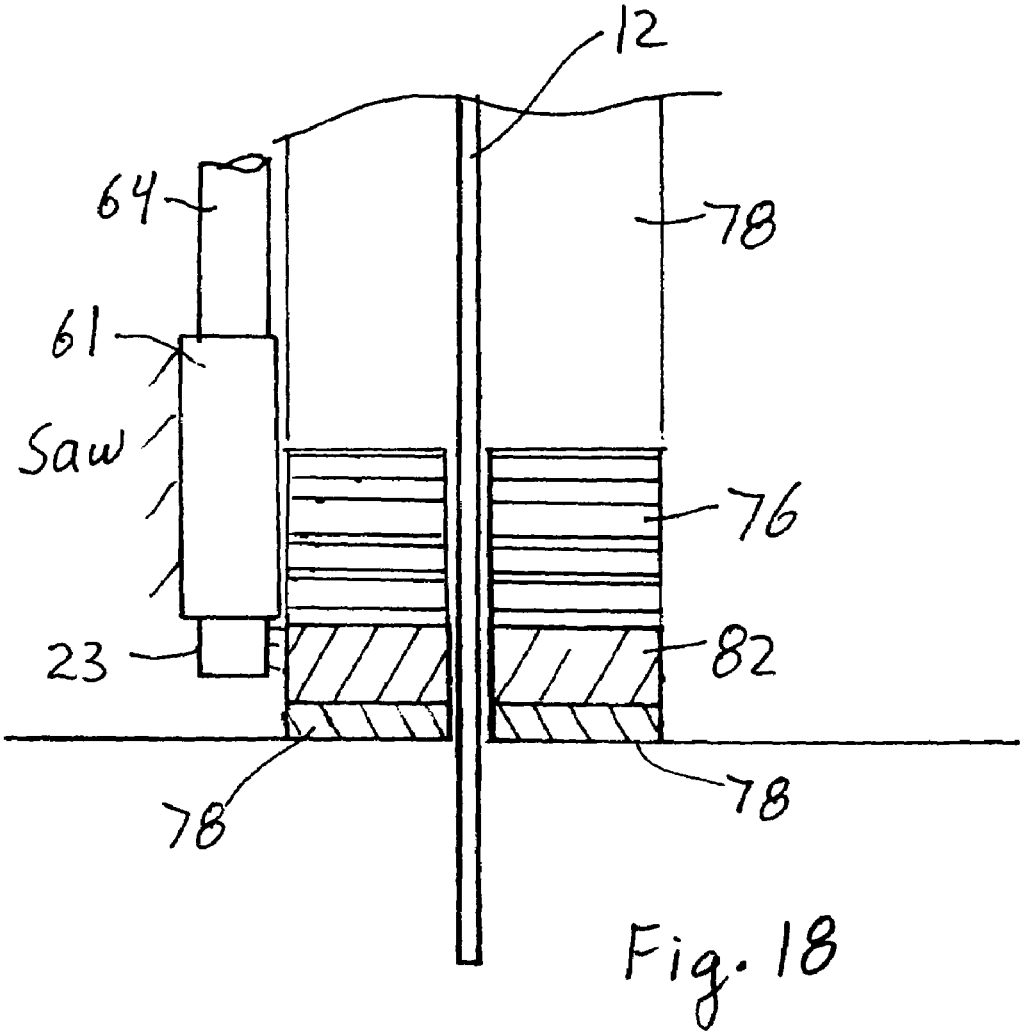
FIG. 18 is a partial sectional view taken along 18—18 of FIG. 17.

Referring to FIGS. 17–18, a further embodiment is illustrated which uses a support 20 comprised of a number of rollers or wheels 70 rotatably mounted to an elongated support 72 (FIG. 12) such as a strip of metal. The wheels 70 are positioned on so they are very close to the cutting blade 12, with the leading and trailing wheels 70*a*, 70*b*, respectively, being located at the location of the upcutting edge of blade 12 and the downcutting edge of blade 12, respectively. Five small wheels 70 and two larger wheels 70*a*, 70*b* are shown on one side of the cutting blade 12. Advantageously the same arrangement of wheels 70 are provided on the opposing side of the cutting blade 12 to support the concrete surface 15 on both sides of the blade 12 as the groove 21 is cut.

The wheels 70 are located sufficiently close to the cutting blade 12 to support the concrete surface 15 during cutting to reduce raveling as the groove 21 is cut. The wheels 70 are preferably of a slightly deformable material that flattens under the weight of the saw 10 so as to better support the concrete surface 15 during cutting. It is believed possible to use only the leading wheels 70*a*, one on each side of the cutting blade and within ⅛ inch and preferably less, of the up-cutting edge of the cutting blade. The nozzle(s) 23 are located in front of the leading wheel 70*a*, and orientated to blow gas streams 54 toward the leading end of the support 20, at a rearwardly inclined angle to the plane of the cutting blade 12, as previously described. Preferably there are at least two nozzles 23, one directed toward each leading wheel 70*a*, with each leading wheel 70*a* located on an opposite side of the plane containing the cutting blade 12.

Figure 13:
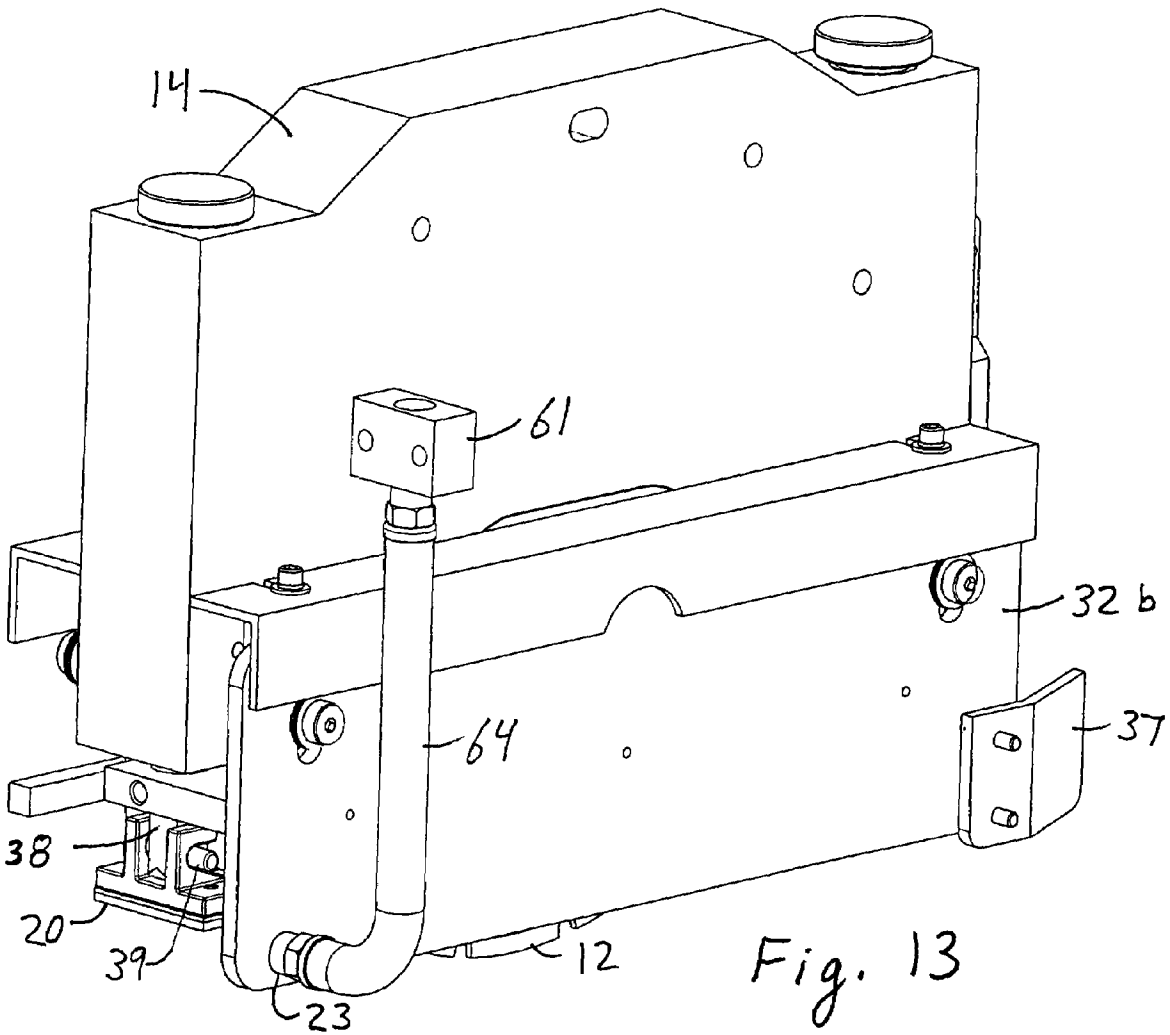
FIG. 13 is a side perspective view of a further embodiment.
Figure 15:
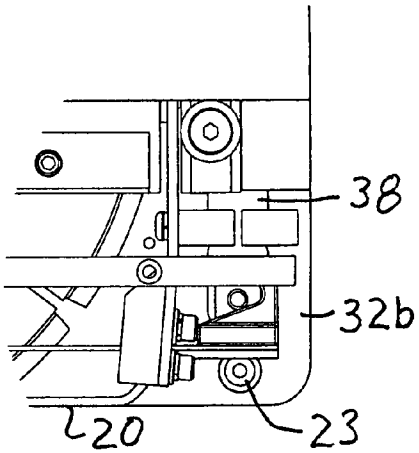
FIG. 15 is an enlarged view taken along 15—15 of FIG. 14.
Figure 14:
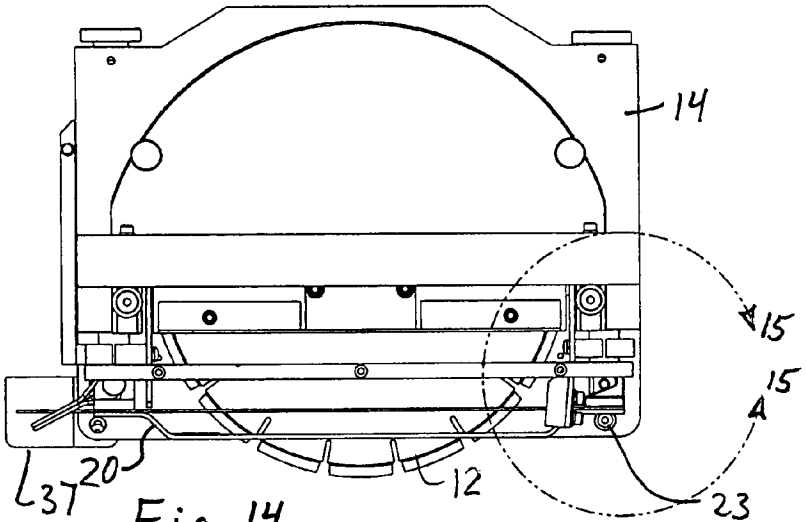
FIG. 14 is side plan view of the embodiment of FIG. 13.
Figure 16:
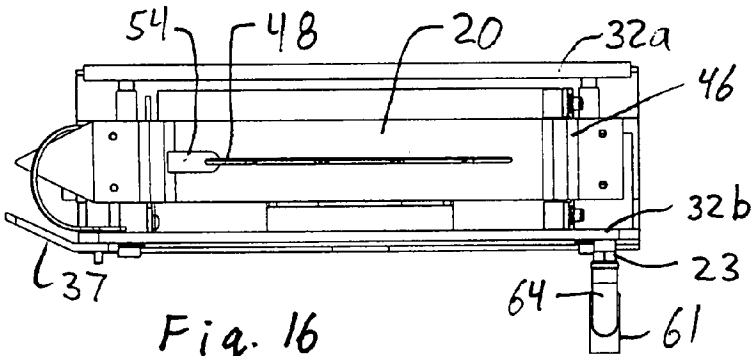
FIG. 16 is a bottom plan view of the embodiment of FIG. 14.

Referring to FIGS. 13–14, a further embodiment of the support 20 is shown comprising a tracked support using toothed guide rollers 76 engaging mating toothed portions on endless tracks 78, with the tracks passing over a plurality of guide rollers 80. The tracks 78 are located sufficiently close to the cutting blade 12 to support the concrete surface during cutting to reduce raveling. There are two tracks 78, each located on opposing sides of the cutting blade 12 to support the concrete surface 21 on opposing sides of the blade 21 during cutting. A belt drive (not shown) rotates the toothed drive rollers 76 to move the tracks 78 at the same rate of travel as the saw 10. A resiliently mounted guide rail 82 resiliently urges the track 78 against the concrete surface 21.

A nozzle 23 mounted to move with the resiliently track 78, or mounted to the saw 10, directs one or more gas streams 54 toward the leading end of the track 78 to clear debris from the concrete surface 15 in the path of the tracks 78.

The above description is given by way of example, and not limitation. Given the above disclosure, one skilled in the art could devise variations that are within the scope and spirit of the invention disclosed herein, including various ways of supporting the concrete surface 15, and various ways of mounting the nozzles 23 to the saw 10 in the described orientations or to achieve the desired removal of debris. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A concrete cutting saw having wheels and a cutting blade that rotates to cut a groove in a concrete surface, the saw having a support for supporting the concrete surface adjacent the cutting blade to reduce raveling of the cut groove, the support having a leading end, comprising:

a source of pressurized gas mounted on the saw;

one or more nozzles mounted to the saw and in fluid communication with the gas source and providing a gas stream, at least one of the nozzles orientated to direct a gas stream toward the support so a gas stream from the nozzle impinges on a leading end of the support, the one or more nozzles being located adjacent to and in front of a leading end of the support.

2. The concrete cutting saw of claim 1, wherein the support is connected on at least one shaft that moves relative to the saw, and the one or more nozzles are mounted to that shaft.

3. The concrete cutting saw of claim 1, wherein the one or more nozzles direct the gas streams in a trailing direction other than in the plane of the cutting blade.

4. The concrete cutting saw of claim 1, wherein the support has a leading end with a surface inclined toward the concrete surface and toward the trailing end of the support.

5. The concrete cutting saw of claim 1, wherein the support has a leading end with a surface inclined toward the concrete surface and toward the trailing end of the support and toward at least one side.

6. The concrete cutting saw of claim 1, wherein there are two nozzles oriented so that gas streams from each nozzle impinge on the leading end of the support on opposing sides of a plane defined by the cutting blade.

7. The concrete cutting saw of claim 1, wherein there is a single nozzle with a fan shaped gas stream that impinges on the leading end of the support on opposing sides of a plane defined by the cutting blade.

8. The concrete cutting saw of claim 1, wherein the support has a leading end with a surface inclined toward the concrete surface and toward the trailing end of the support.

9. The concrete cutting saw of claim 1, wherein the support has a leading end with a surface inclined toward the concrete surface and toward the trailing end of the support and also inclined relative to the plane of the rotating cutting blade.

10. The concrete cutting saw of claim 1, wherein the support comprises a skid plate.

11. The concrete cutting saw of claim 1, wherein the support comprises at least one wheel.

12. The concrete cutting saw of claim 1, wherein the support comprises a wheeled track.

13. The concrete cutting saw of claim 1, wherein there are at least two nozzles each producing a gas stream directed toward the support during use of the saw.

14. A concrete cutting saw having wheels and a support for supporting the concrete surface adjacent a rotating cutting blade that extends through the support to cut the concrete surface, the support having a leading end, comprising:

a source of pressurized gas mounted on the saw;

nozzle means on the saw in fluid communication with the gas source for removing debris from in front of the support by blowing gas toward the skid plate.

15. The concrete saw of claim 14, wherein the support moves relative to the saw and the nozzle means is mounted to move with the support.

16. The concrete saw of claim 14, wherein the support moves relative to the saw and the nozzle means is mounted to move with the support.

17. The concrete saw of claim 14, wherein the support comprises a skid plate mounted to the saw on a shaft so as to move relative to the saw, and wherein the nozzle is mounted to move with the support.

18. The concrete saw of claim 14, wherein the cutting blade is substantially enclosed and the support moves relative to the closure, with the nozzle means mounted to move with the support.

19. The concrete saw of claim 14, wherein the cutting blade is substantially enclosed and the support moves relative to the closure, with the nozzle means mounted so it does not move with the support.

20. A method for cutting a groove in a green concrete surface using a dry cutting concrete saw with a rotating cutting blade with a support supporting the concrete surface adjacent a leading end of the cutting blade to reduce raveling, comprising:

from a location in front of the support, blowing at least one stream of gas in a rearward direction other than in the plane of the cutting blade, the stream impinging against a front of the support; and providing sufficient gas flow or pressure to the stream of gas to move debris from a path of the support.

21. The method of claim 20, further comprising:

moving the support relative to the cutting blade; and moving the stream of gas with the support.

22. The method of claim 20, wherein the support comprises a skid plate, and wherein the blowing step further comprising blowing at least two streams of gas.

23. The method of claim 20, wherein the support comprises a skid plate, and wherein the blowing step further comprising blowing at least two streams of gas with each gas stream directed toward the support on a different side of the cutting blade.

24. The method of claim 20, wherein the blowing step comprises blowing two streams of gas from locations on one side of a plane containing the cutting blade, toward the plane containing the cutting blade.

25. The method of claim 20, wherein the blowing step comprises blowing the gas stream to impinge on the support before impinging on the concrete.

* * * * *